United States Patent [19]

Kurtz

[11] Patent Number: 4,685,759

[45] Date of Patent: Aug. 11, 1987

[54] ENERGIZABLE LAMP SOCKET

[76] Inventor: John G. Kurtz, 45 Oak Bend La., Rochester, N.Y. 14617

[21] Appl. No.: 817,472

[22] Filed: Jan. 9, 1986

[51] Int. Cl.[4] ..... H01H 19/00

[52] U.S. Cl. ..... 200/51.14; 200/153 P; 200/153 N; 200/155 R; 200/336

[58] Field of Search ..... 339/50 R, 186 R, 186 L, 339/50 C, 51, 55, 110 L, 119 L, 176 L, 182 L, 206 L, 278 L; 200/153 P, 153 N, 153 LB, 333, 336, 155 R

[56] References Cited

U.S. PATENT DOCUMENTS

| | | | |
|---|---|---|---|
| 2,427,583 | 9/1947 | Von Mertens | 200/153 P |
| 3,227,826 | 1/1966 | Beare | 200/336 |
| 4,132,129 | 1/1979 | Pratt | 200/336 |
| 4,154,125 | 5/1979 | Frank | 200/336 |

*Primary Examiner*—Gil Weidenfeld
*Assistant Examiner*—Thomas M. Kline
*Attorney, Agent, or Firm*—Warren W. Kurz

[57] ABSTRACT

An incandescent lamp socket comprises a housing for receiving the base portion of an incandescent lamp and switch means for selectively connecting the lamp's contacts to a source of electrical energy. Such switch means comprises a rotatably mounted cylindrical sleeve which surrounds the socket housing, and means responsive to rotational movement of the sleeve relative to the housing for selectively connecting the lamp contacts to the energy source. Preferably, such connecting means comprises a planetary ring gear disposed along the interior wall of the sleeve, a cooperating pinion gear mounted for rotational movement on the socket housing, cam means rigidly coupled to the pinion gear and rotatable therewith, and electrically energized cam follower means, movable in response to the cam means to selectively energize certain socket electrodes which are connected to the contacts of a lamp supported by the socket housing. According to another embodiment, the pinion gear is used to control the output of a conventional potentiometer which, in turn, controls lamp power.

16 Claims, 14 Drawing Figures

ENERGIZABLE LAMP SOCKET

BACKGROUND OF THE INVENTION

This invention relates to energizable lamp sockets for use in household lighting fixtures (e.g. table, floor and wall-mounted lamps for selectively applying electrical power to an incandescent electric lamp.

Most conventional lamp sockets have push-button, twist-type or pull chain activated switches which are, at times, difficult to locate, especially so when hidden by a lamp shade and thereby locatable only by touch. It would be desirably to provide a lamp socket switch which, even though hidden from sight, can be readily grasped and operated by the user without regard to the user's position relative to the lamp socket switch.

SUMMARY OF THE INVENTION

According to the invention, there is provided a selectively energizable lamp socket in which electrical energy is selectively applied to the electrical contacts of a received incandescent lamp by switch means comprising a rotatably mounted cylindrical sleeve which is concentrically arranged relative to the lamp socket housing. Means, positioned within the sleeve and responsive to rotational movement of the sleeve, are provided for selectively connecting and disconnecting the lamp contacts and a source of electricity. In accordance with a preferred embodiment, such connecting means comprises rotatably mounted cam means which rotates in response to manual rotation of the sleeve, and electrically energizable cam follower means which moves, in response to cam means rotation, between a first position in which it engages the lamp contacts and applies electrical energy thereto, and a second position in which it is spaced from such contacts. Preferably, the cam means is mounted for rotation by a pinion gear which is rotatably mounted on the socket housing and positioned to be rotatably driven by a planetary ring gear mounted within the manually rotatable sleeve. This basic arrangement and combination of parts is useful in applying energy to lamps with single or multiple (e.g. three-way) filaments. In accordance with another embodiment, the combination of the planetary ring gear and the pinion gear is used to control the position of the resistance-varying shaft of a potentiometer which, in turn, controls the voltage applied to a single filament lamp.

The invention will be better understood from the ensuing detailed description of preferred embodiments, reference being made to the accompanying drawings.

DETAILED DESCRIPTION OF PREFERRED EMBODIMENTS

Figure 1:
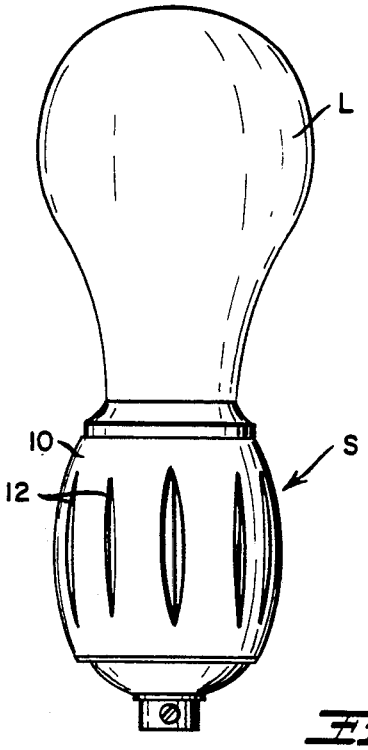
FIG. 1 is a side elevational view of an energizable lamp socket embodying the present invention.

Referring now to the drawings, FIG. 1 illustrates a conventional single filament incandescent lamp L supported by an electrically-energizable socket S embodying a preferred form of the present invention. As will be explained in more detail below, electric energy is selectively applied to the lamp's filament by rotating a generally cylindrically shaped sleeve 10 about its longitudinal axis A. Preferably, the outer surface of sleeve 10 is shaped and contoured, such as by grooves 12 or flats (not shown), to be readily gripped and rotated by hand. By virtue of the mechanism within the sleeve, lamp energization and de-energization is independent of the direction of sleeve rotation.

Figure 2:
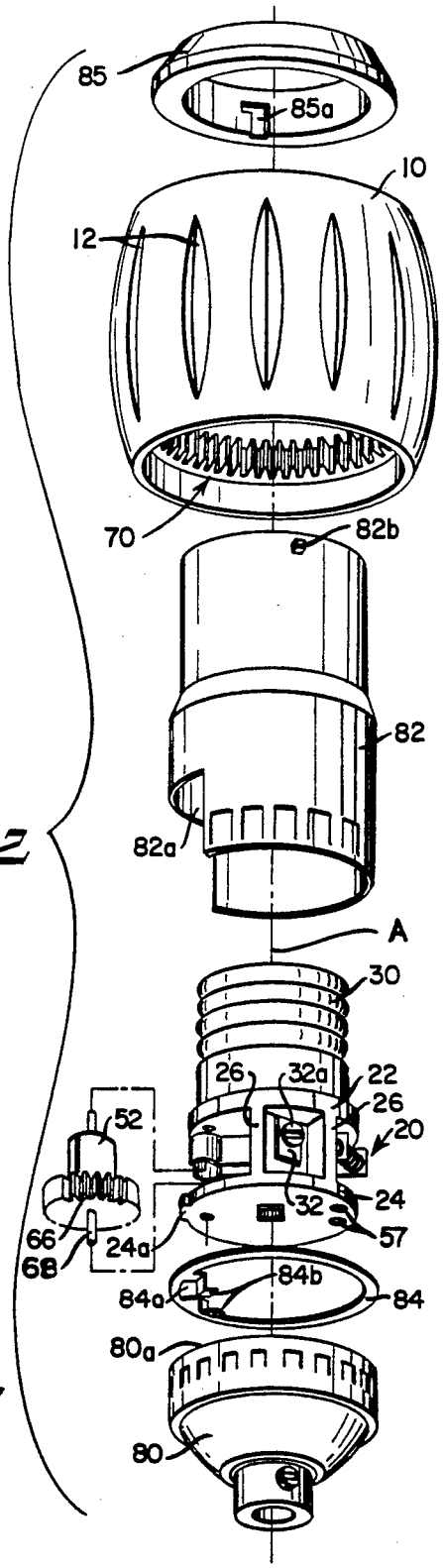
FIG. 2 is an exploded view of the lamp socket shown in FIG. 1.

Referring to the exploded view of FIG. 2, socket S comprises a non-conductive (e.g. plastic) housing 20 comprising upper and lower platforms 22, 24, respectively, and a plurality of interconnecting walls 26. Platform 22 supports a cylindrically-shaped electrode 30, the wall of which is adapted to receive the threaded base contact of lamp L. Electrode 30 is electrically connected to a conductive member 32 which is supported by one of the housing walls 26. Conductive member 32 supports a contact screw **32*a*** which is adapted to be connected to one of the two leads of a standard electric power cord.

Figure 3:
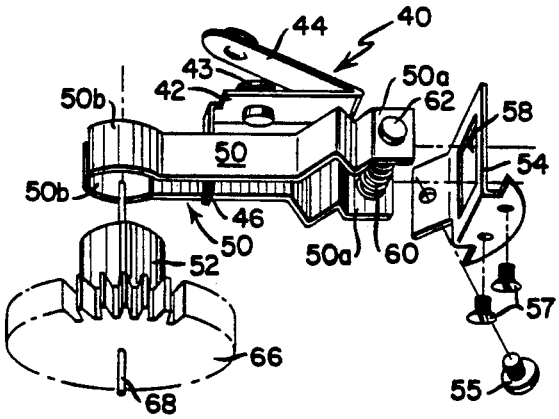
FIG. 3 is an enlarged exploded view of a portion of the apparatus shown in FIG. 2.

Referring additionally to FIG. 3, the upper surface of platform 22 also supports a second electrode 40 which is spaced from and centrally disposed relative to the cylindrical electrode 30. Electrode 40 has a flat portion 42 which is fastened to the upper surface of platform 22 by a screw 43, an angularly disposed portion 44 which engages the tip contact of a lamp received by the threaded electrode 30, and a depending tab 46 which protrudes through platform 22 into the region separating platforms 22 and 24. It is tab 46 which is selectively connected to a source of electrical energy (by the mechanism next described) to complete the lamp circuit.

Figure 4A:
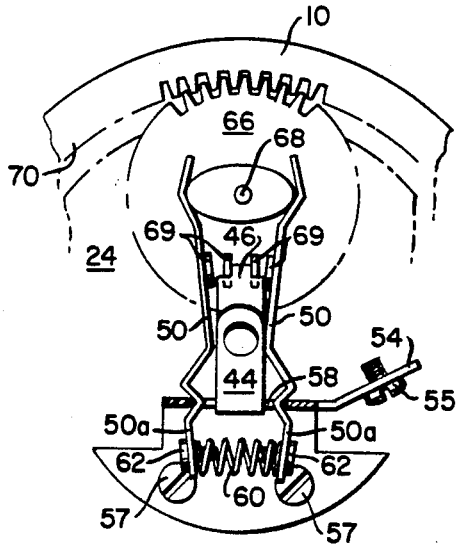
FIGS. 4B and 4A are top elevations of a portion of the FIG. 2 apparatus showing the electrode structure in "on" and "off" positions, respectively.
Figure 4B:
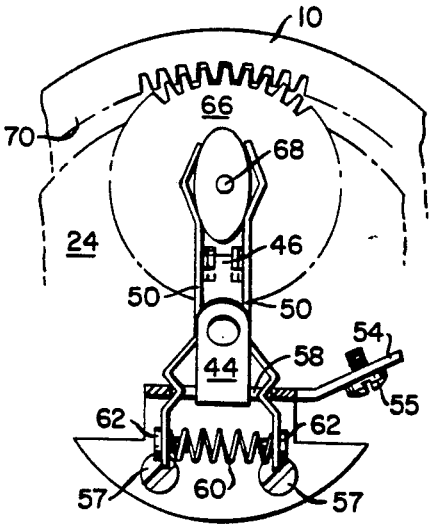

As shown in FIGS. 3 and 4A and 4B, tab 46 is positioned between a pair of electrically conductive cam follower members 50 which move toward and away from each other under the influence of a rotating cam member 52. The cam follower members are always "hot", that is , electrically energized due to their physical contact with an electrode 54, the latter being directly connected to the other lead of the aforementioned power cord by screw contact 55. Electrode 54 is connected to the lower platform 24 of housing 20 by screws 57. Cam follower members 50 protrude through an aperture 58 formed in electrode 54, and good electrical contact is assured by a compression spring 60 which urges the ends **50*a* of members 50 into engagement with the lateral edges of aperture 58. Spring 60 also serves to cam follower ends 50*b* into intimate contact with cam member 52. Locating pins 62 mounted on each of the cam follower ends 50*a* serve to keep the spring in its proper position between ends 50*a***.

Each of the cam follower members 50 has an elbow-shaped end **50*b* which is urged into engagement with, and thereby accurately follows the movement of, cam member 52. The cam member is supported by and rotates with a pinion gear 66 which is rotatably supported by an axle 68 which is rotatably supported by and extends between platforms 22 and 24. Pinion gear 66 is positioned so that its teeth are engaged and driven by teeth of a planetary ring gear 70 which is supported by, and is preferably integral with, the interior wall of sleeve 10. The operation of the socket can be best understood with reference to FIGS. 4A and 4B. As pinion gear 66 rotates in response to rotation of sleeve 10 and its internal planetary ring gear 70, cam 52 rotates between the two positions shown. In FIG. 4A, the position of cam 52 serves to space the electrically energized cam follower members 50 apart from tab 46; hence, in this position, no power is applied to the lamp's tip contact 102, and the lamp is "off". In FIG. 4B, the cam member is turned 90 degrees, in which case the cam followers are allowed to move toward each other (under the influence of spring 60) and make electrical contact with the tab portion 46 of electrode 40, thereby completing the lamp circuit and turning the lamp "on". To assure good electrical contact between tab 46 and members 50, breaker points 69** may be provided, as shown.

From the foregoing description, it will be apparent that the direction of rotation of sleeve 10 is not critical to the operation of the device. If the lamp is already energized when the sleeve is initially rotated, as would be the case shown in FIG. 4B, rotation of the sleeve 10 in either direction will cause a break in the electrical circuit. Obviously, the converse is true. Also advantageous is that any slight welding or fusing between the contacts can be easily broken by the relatively strong force provided by the rotating cam member. Also, a strong detent "feel" is provide by the combined effect of the compression spring and the shape of the cam member. Note, once the cam member rotates to about its 45 degree position, half way between the positions shown in the drawings, the cam followers will snap into the intended next position.

Regarding the sleeve member 10, it is preferably made of a plastic material. Its internal planetary ring gear 70 may be formed separately from the sleeve and, for example, press fit into the sleeve's interior surface. Preferably, however, the ring gear is integrally formed with the sleeve's inner surface, such as by standard injection molding techniques.

Referring again to FIG. 2, housing 20 and its associated structure are contained by a conventional two-piece, snap-together socket housing consisting of a base portion 80 and an upper portion 82. The upper portion of this socket has been modified by the addition of a transverse opening **82*a* which, in cooperation with the upper edge 80*a* of base 80 provides a slot through which a portion of the pinion gear 66 protrudes for engagement by the ring gear 70. To prevent housing 20 from rotating as sleeve 10 is rotated, platform 24 of the electrode housing 20 is provided with a key 24*a* which is arranged to engage a notch 84*a* defined by a pair of tabs 84*b* depending from a bearing ring 84. Ring 84 is multipurpose, providing a bearing surface for rotably supporting the bottom edge of the ring gear, providing a dust cover for the ring gear and, as already mentioned, providing a means for preventing undesired movement of housing 20. Also to be noted is that tabs 84*b* prevent the entire housing 20 from sagging into the socket base 80 during assembly. When assembled, the top of upper housing portion 82 extends above the top of sleeve 10. A retainer ring 85 having a plurality of cut-outs 85*a* which are located to engage opposed embossings 82*b* on upper housing portion 82** serves to lock the assembly together.

Figure 5:
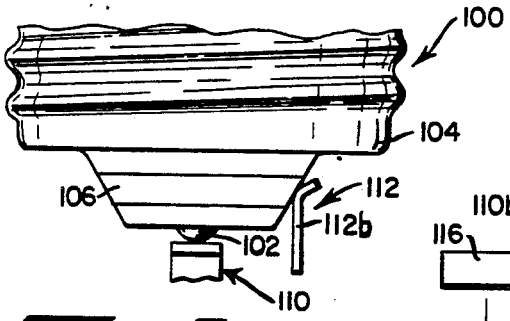
FIG. 5 is a fragmentary view of a portion of a three-way incandescent lamp base.

Referring now to FIG. 5, there is shown a fragment of the base portion of a conventional three-way incandescent lamp 100. Such a lamp has three electrical contacts, a center tip contact 102, a threaded base contact 104, and an intermediate ring contact 106. The lamp has two filaments, a 100-watt filament connected between lamp contacts 102 and 104, and a 50-watt filament connected between contacts 104 and 106. As in the case of the above-described single filament lamp, contact 104 is directly connected to one of the two leads of a power cord, and either or both of the lamp filaments are selectively energized by connecting either or both contacts 102 and 106 to an energy source. When the threaded base contact is screwed into the threaded socket electrode, such as electrode 30 in FIG. 2, center tip contact 102 engages socket electrode 110, shown in FIGS. 5 and 6, and ring contact 106 engages a third socket electrode 112. The mechanism for selectively connecting electrodes 110 and 112 to a source of electrical energy in response to rotational movement of sleeve 10 is described below.

Figure 6:
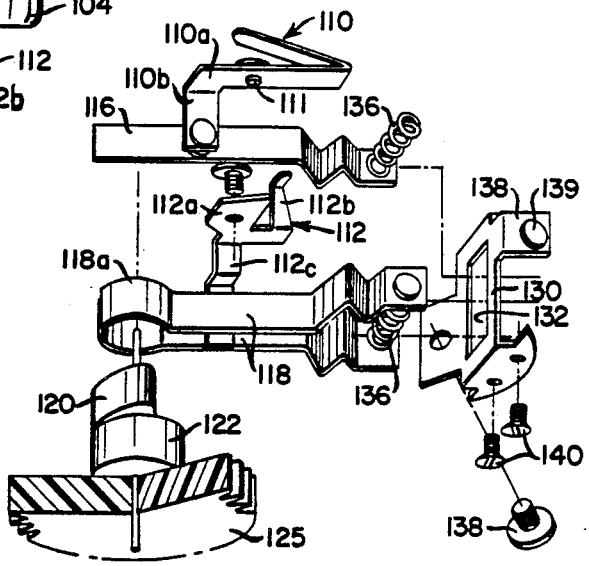
FIG. 6 is an exploded view of a portion of a three-way lamp socket according to another preferred embodiment.

Referring to FIG. 6, the apparatus shown is supported by the same socket housing 20 as already described above with reference to FIG. 2. The horizontal portion **110*a* of electrode 110 is fastened to the top surface of the housing's platform 22, and its depending tab 110*b* extends downwardly, through an aperture formed in platform 22, into the region between the platforms 22 and 24. There, tab 110*b* is selectively engaged by an electrically energized cam follower member 116 which moves toward and away from the the tab as it follows the contour of a cam member 120, described in more detail below. Electrode 112 comprises a flat flange 112*a* which is fastened to the bottom surface of platform 22. Extending upwardly from flange 112*a* is an upright portion 112*b* which protrudes through an aperture in platform 22 and engages the ring contact 106 of a received lamp. Extending downwardly from flange 112*a*, into the space separating the socket's platforms 22 and 24 is a tab 112*c*. As in the case of the electrode tab 46 in the above-described embodiment, tab 112*c* is arranged between a pair of electrically energized cam follower members 118 which move toward and away from each other, into and out of engagement with tab 112*c*, as they follow the contour of a second cam member 112. The cam follower members are electrically energized by virtue of their contact with an electrode 130 having a shape similar to electrode 54 in FIG. 3. The cam followers extend through an aperture 132 formed in electrode 130, and springs 136 serve to urge the cam followers into intimate contact with the lateral edges of the electrode aperture. Note, the spring associated with the upper cam follower 116 is positioned by a locating pin on member 116 and by a pin 139 borne by electrode 130. Electrode 130 is directly connected to an energy source by contact screw 138, and a pair of screws 140 serve to fasten the electrode to the lower socket platform 24**.

As best shown in FIG. 6, cam members 120 and 122 are stacked one above the other on top of a pinion gear 125. All three members share the same axis of rotation, defined by the longitudinal axis of axel 68. Cam member 122 is identical in shape to cam member 52 described above, having to lobes which are 180 degrees apart.

While cam member 120 also has two lobes, it differs in shape from cams 122 and 52 in that its two lobes are only 90 degrees apart, or 270 degrees, depending on the direction of measurement. The pinion gear and its associated cam members are mounted for rotation between platforms 22 and 24 in the same manner as the above-mentioned pinion gear 66 and cam 52. Preferably, the pinion gear and cam members are integrally connected, being formed by a standard injection molding technique. Again, the pinion gear is located on housing 20 such that a several of the teeth thereof are engaged and driven by the teeth of the planetary ring gear within sleeve 10.

Figure 7A:
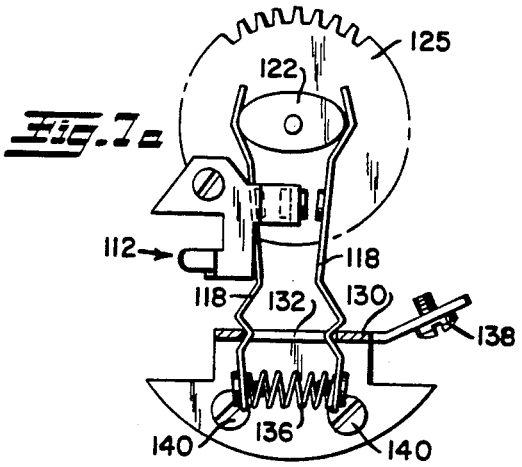
FIGS. 7A and 7B, and 8A–8D are top elevations of a portion of the FIG. 6 apparatus showing the relative positions of elements for various operating and non-operating conditions.
Figure 7B:
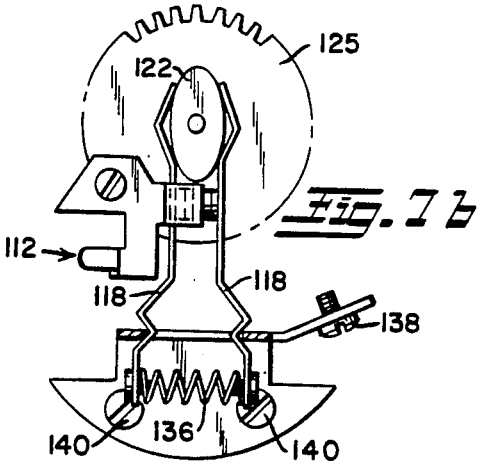

The operation of the three-way socket of this particular embodiment of the invention will be better understood by referring to FIGS. 7A and 7B, and FIG. 8A–8D. As cam member 122 rotates, the 50 watt filament is alternately turned "on" and "off" as the cam's position is changed between the two positions shown in FIGS. 7A and 7B. In FIG. 7A, cam 122 is positioned so that the electrically energized cam follower members 118 are allowed to contact tab 112*c* and thereby energize the ring electrode 106 and the 50 watt filament connected thereto. In FIG. 7B, cam 122 is positioned to space the cam followers sufficiently apart to prevent electrical contact between the cam members and tab 112*c;* as a result, no power is applied to the 50 watt filament. Thus, it is apparent that, for each full revolution of gear 122, energy is turned on and off twice, each change in state being separated by a 90 degree cam rotation.

Figure 8A:
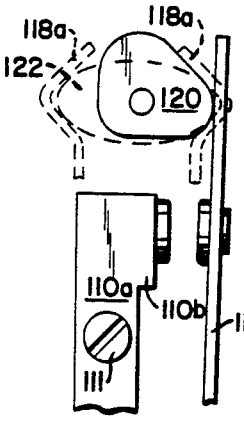
Figure 8B:
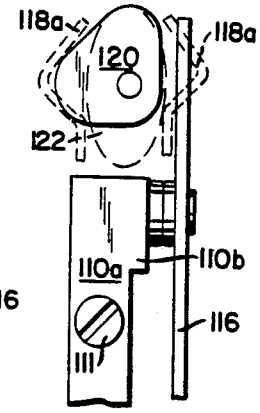
Figure 8C:
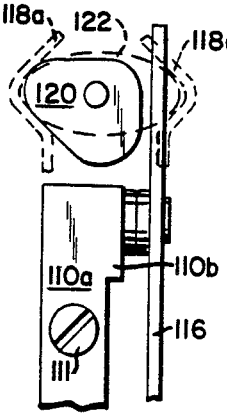
Figure 8D:
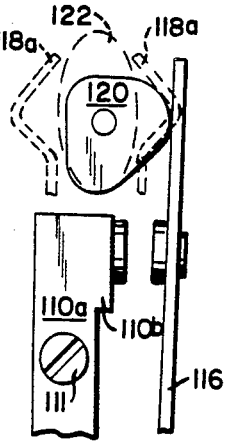

Coincidentally with the rotation of cam 122 is the rotation of cam 120. When cam 120 is in the position shown in FIG. 8A, one of its two lobes serves to space cam follower 116 from electrode 110 and thereby prevent energization of the 100 watt filament. When cam 122 is also in a position to prevent energization of electrode 112, the lamp is in its "off" condition, as shown in FIG. 8A. After the two cams have rotated 90 degrees in a counter-clockwise direction to the positions shown in FIG. 8B, both of the cam members are positioned to allow their associated cam followers to make contact with, and thereby energize, their associated electrodes. Thus, in FIG. 8B, both lamp filaments are energized and the lamp power is 150 watts. As the cam members rotate 90 degrees further in a counter-clockwise direction, cam 120 is still in a position to allow energization of electrode 110; however, cam 122 will have rotated to a position in which it de-energizes electrode 112. This condition is depicted in FIG. 8C where only the 100 watt filament is energized. In FIG. 8D, the cam members have been rotated 90 degrees further and, as shown, cam 120 acts to de-energize electrode 116 and its associated 100 watt filament, while cam 122 allows energization of the 50 watt filament via electrode 112.

Figure 9:
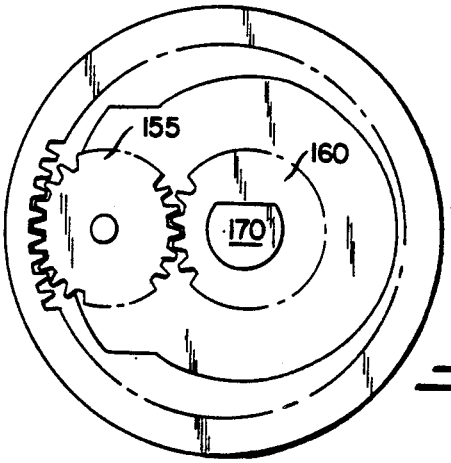
FIG. 9 illustrates still another embodiment of the invention.

In FIG. 9, another embodiment of the invention is shown. Here, the combination of a ring gear 155 and pinion gear 155 are used to drive a second pinion gear 160 whose central portion is fixed to the stem 170 of a conventional potentiometer (not shown). The ring gear, of course, is arranged within a sleeve like sleeve 10 in FIG. 2. As the sleeve is manually rotated, the resistance of the potentiometer is varied, thereby varying the lamp power. Obviously, the potentiometer is connected in the power line to vary the voltage applied to the lamp-contacting electrode 40.

From the foregoing, it is apparent that a relatively low-cost and highly advantageous lamp socket has been provided. By merely twisting the sleeve which surrounds the lamp base, power is applied to the lamp, and the need to locate a mechanical switching mechanism is obviated. While the invention has been described with reference to certain preferred embodiments, obvious modifications will become self-evident to those skilled in the art, and such are intended to be within the spirit and scope of the invention, as defined by the accompanying claims.

I claim:

1. In a lamp socket adapted to receive an incandescent lamp of the type having a cylindrically shaped base supporting a plurality of spaced electrical contacts through which electrical energy can be selectively connected to lamp filament(s), said socket comprising a housing for receiving the lamp base, said housing supporting a plurality of spaced electrodes which engage said contacts when a lamp base is received by said housing, the improvement comprising:

switch means for selectively connecting at least one of said electrodes to a source of electrical energy, said switch means comprising (a) a cylindrically shaped sleeve concentrically arranged with respect to and surrounding the cylindrical base of a lamp received by said housing, said sleeve having a planetary ring gear arranged about its interior surface; (b) means for supporting said sleeve for rotational movement about its longitudinal axis; (c) a pinion gear rotatably mounted on said housing and positioned to be rotatably driven in response to rotational movement of said sleeve; and (d) connecting means responsive to to rotational movement of said pinion gear for selectively connecting and disconnecting said at least one electrode to a source of electrical energy.

2. The invention according to claim 1 wherein said planetary gear is integral with the interior surface of said sleeve.

3. The invention according to claim 1 wherein said connecting means is responsive to rotational movement of said pinion gear in either direction.

4. The invention according to claim 1 wherein said connecting means comprises cam means operatively coupled to said pinion gear and movable therewith in response to rotational movement of said sleeve; and electrically conductive cam follower means adapted to be operatively coupled to a source of electrical energy, said cam follower means being movable in response to movement of said cam means between a first position in which it engages one of said electrodes and a second position in which it is spaced from said at least one electrode.

5. The invention according to claim 4 wherein said cam means comprises a cam member rigidly connected to said pinion gear and movable therewith.

6. The invention according to claim 4 further comprising detent-defining means for resisting movement of said cam follower means when said cam follower means is in either said first or second position.

7. The invention according to claim 6 wherein said detent-defining means comprises means for urging said cam follower means into engagement with said cam member.

8. The invention according to claim 7 wherein said urging means comprises a spring.

9. The invention according to claim 4 wherein said cam means comprises a cam member having two diametrically opposed lobes, whereby said cam follower means is moved between its first and second positions twice for each complete rotation of said pinion gear.

10. The invention according to claim 1 wherein said connecting means comprises a potentiometer having a rotatable shaft for varying the electrical resistance of said potentiometer, the angular position of said shaft being determined by the angular position of said pinion gear.

11. The invention according to claim 1 wherein said housing supports three spaced electrodes which engage a like number of lamp contacts, wherein said switch means comprises means for selectively connecting either or both of two of said electrodes to a source of electrical energy, and wherein said connecting means comprises a pair of cam members, each cam member being operatively coupled to said pinion gear for movement therewith, and a pair of cooperating cam followers, each cam follower being movable by its cooperating cam member between a first position in which it acts to connect one of said two electrodes to a source of electrical energy, and a second position in which it acts to disconnect said one electrode from said source.

12. In a selectively energizable lamp socket of the type comprising a housing adapted to receive the base portion of a three-way incandecent lamp, said base portion having first, second and third electrodes which engage a corresponding number of lamp contacts to supply electrical-energy to lamp filaments, the improvement comprising:

switch means for selectively connecting to a power source (a) said first and second electrodes, or (b) said first and third electrodes, or (c) said first and second electrodes and said first and third electrodes, said switch means comprising:

(i) gear means rotatably mounted on said housing, (ii) first and second cam means rigidly connected to said gear means for rotation therewith, and (iii) first and second cam follower means, operatively coupled to said first and second cam means, respectively, for selectively connecting said, second and third electrodes to a power source, said first cam means and said first cam follower means cooperating to selectively connect said first and second electrodes to a source of electrical energy, and said second cam means and said second cam follower means cooperating to selectively connect said third electrodes to said source.

13. The invention according to claim 12 wherein said housing is cylindrical in shape and has a central longitudinal axis, and said gear means is rotatably supported to rotate about an axis parallel to said longitudinal axis.

14. The invention according to claim 13 further comprising cylindrical sleeve means surrounding said housing and rotatably supported to rotate about said longitudinal axis, said sleeve means comprising means for rotatably driving siad gear means when said sleeve means is rotated in either direction about said longitudinal axis.

15. The invention according to claim 12 further comprising means for resisting movement of said cam follower means when said cam follower means are in energy-connecting and energy-disconnecting positions.

16. In a selectively energizable lamp socket comprising a cylindrical housing for receiving the base of a multifilament incandescent lamp of the type having at least three electrical contacts by which electrical energy can be selectively applied to either or both of two lamp filaments, the improvement comprising:

switch means for selectively coupling two of the lamp contacts to a source of electricity to selectively energize either or both of said filaments, said switch means comprising (a) a cylindrical sleeve coaxially arranged with respect to said housing, said sleeve having a planetary ring gear arranged on the interior surface thereof; (b) means for rotatably supporting said sleeve for rotational movement about the central axis of said cylindrical housing; (c) a pinion gear positioned to be rotatably driven by said ring gear; (d) first and second cam members rigidly coupled to said pinion gear and rotatable therewith; (e) first and second electrically conductive cam follower means operatively coupled to said first and second cam members, respectively; and first and second spaced electrodes respectively positioned to engage such two lamp contacts when a lamp is received by said threaded cylindrical housing, said first and second cam follower means being respectively movable by said first and second cam members into and out of engagement with said first and second spaced electrodes, said cam members and said follower means cooperating to connect either or both of said lamp filaments to a source of electrical energy in response to rotational movement of said pinion gear means.

* * * * *